US007301292B2

(12) United States Patent
Schmitt

(10) Patent No.: US 7,301,292 B2
(45) Date of Patent: Nov. 27, 2007

(54) CIRCUIT ARRANGEMENT FOR OPERATING AT LEAST ONE FIRST AND ONE SECOND LAMP WHICH CAN BE INSERTED IN SAID CIRCUIT ARRANGEMENT

(75) Inventor: Harald Schmitt, München (DE)

(73) Assignee: Patent-Treuhand-Gesellschaft fur Elektrische Gluhlampen mbH, Munich (DE)

( * ) Notice: Subject to any disclaimer, the term of this patent is extended or adjusted under 35 U.S.C. 154(b) by 106 days.

(21) Appl. No.: 11/385,703

(22) Filed: Mar. 22, 2006

(65) Prior Publication Data

US 2006/0214602 A1 Sep. 28, 2006

(30) Foreign Application Priority Data

Mar. 24, 2005 (DE) ..... 10 2005 013 898

(51) Int. Cl.
*H05B 39/00* (2006.01)

(52) U.S. Cl. ..... 315/312

(58) Field of Classification Search ..... 315/224, 315/291, 307, 312, 324, DIG. 2, DIG. 5; 323/355

See application file for complete search history.

(56) References Cited

U.S. PATENT DOCUMENTS 6,819,063 B2 * 11/2004 Nemirow ..... 315/308
6,919,693 B2 * 7/2005 Fushimi ..... 315/219
2002/0105283 A1 * 8/2002 Murakami et al. ..... 315/224
2002/0140376 A1 10/2002 Kamata et al.
2004/0113566 A1 6/2004 Nemirow
2004/0212319 A1 10/2004 Fushimi

FOREIGN PATENT DOCUMENTS

EP 1 309 060 5/2003

OTHER PUBLICATIONS

European Search Report dated Sep. 1, 2006 from corresponding EP Application No. 06005212.3-2206, 7 pages.

* cited by examiner

*Primary Examiner*—Shih-Chao Chen
*Assistant Examiner*—Minh Dieu A
(74) *Attorney, Agent, or Firm*—Carlo Bessone

(57) ABSTRACT

A circuit arrangement for operating at least one first and one second lamp which can be inserted in the circuit arrangement, each lamp having a first and a second filament, having a drive circuit for the purpose of driving the at least one first and second lamp, the drive circuit being designed to operate the at least one first and second lamp using a radiofrequency signal, it also includes: a comparator circuit for comparing a first and a second voltage potential within the circuit arrangement, and a deactivation apparatus for deactivating the drive circuit, the comparator circuit being designed to activate the deactivation apparatus if the difference between the first and the second voltage potential exceeds a predeterminable limit value during operation of the at least one first and one second lamp using a radiofrequency signal.

12 Claims, 1 Drawing Sheet

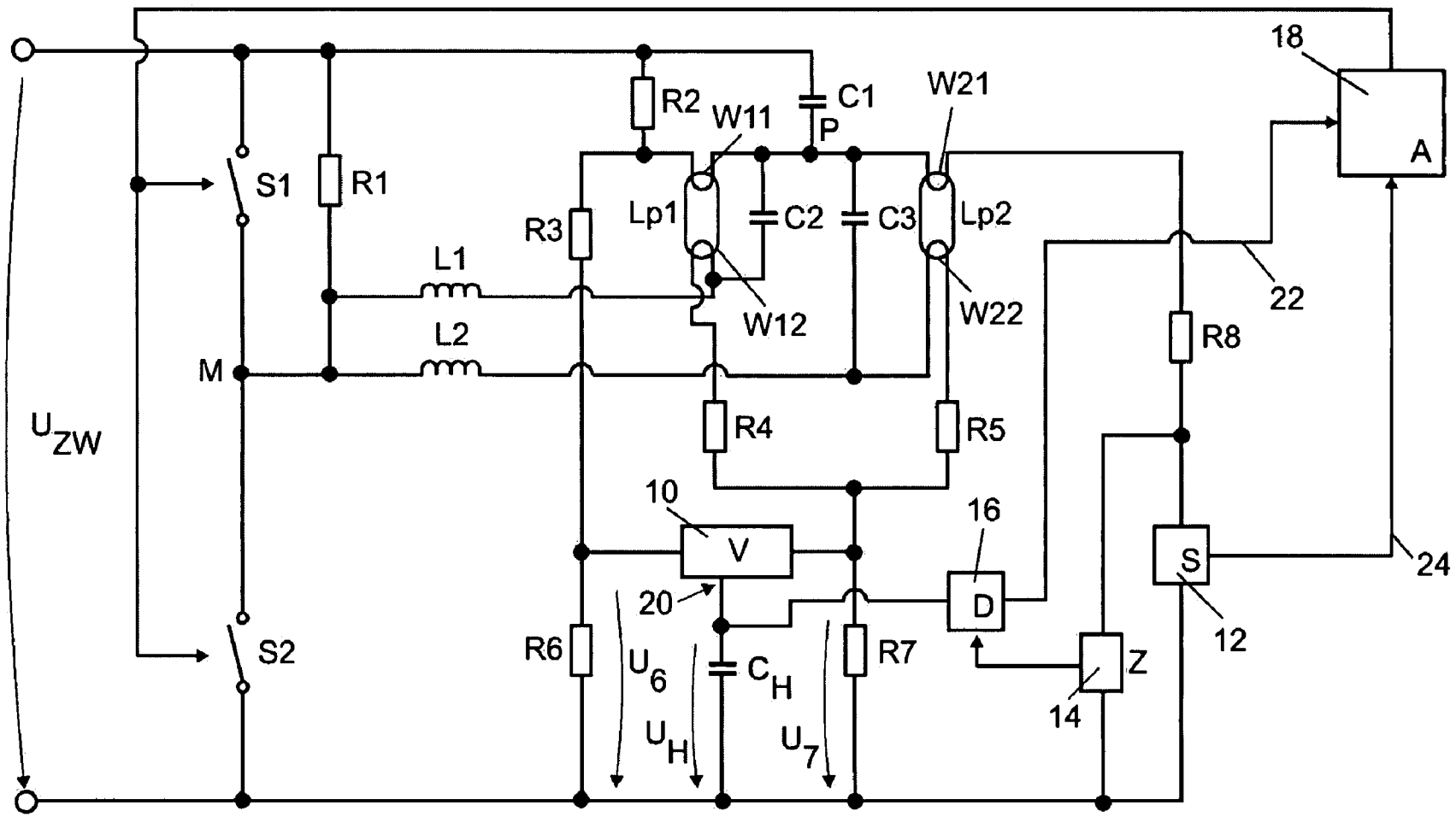
A
18
24
22
R8
S
12
Z
14
D
16
R5
Lp2
W21
W22
C3
C1
P
C2
W11
W12
R2
Lp1
R4
V
10
20
R7
$U_7$
$C_H$
$U_6$
$U_H$
R3
R6
L1
L2
R1
S1
S2
M
$U_{ZW}$

CIRCUIT ARRANGEMENT FOR OPERATING AT LEAST ONE FIRST AND ONE SECOND LAMP WHICH CAN BE INSERTED IN SAID CIRCUIT ARRANGEMENT

FIELD OF THE INVENTION

The present invention relates to a circuit arrangement for operating at least one first and one second lamp which can be inserted in said circuit arrangement, each lamp having a first and a second filament, having a drive circuit for the purpose of driving the at least one first and second lamp, the drive circuit being designed to operate the at least one first and second lamp using a radiofrequency signal.

BACKGROUND OF THE INVENTION

Such a circuit arrangement is known from the prior art. If the drive circuit is now in the form of a remote-controlled electronic ballast, there is the risk of the removal of a lamp from the circuit arrangement during operation not being recognized if the corresponding load circuit is not monitored. The corresponding load circuit can then continue to operate in the so-called capacitive mode. Owing to the lack of damping by the lamp removed and given an unchanged operating frequency, the switches which are generally used as transistors in the drive circuit are no longer operated at the optimum time, at which the transistors are without voltage, but at times at which a voltage is present across the transistor and, at the same time, current flows through the transistor. The power loss which is thereby increased and is converted in the transistor may lead to heating of the transistor which may result in destruction of the transistor.

SUMMARY OF THE INVENTION

The object of the present invention therefore consists in developing the circuit arrangement mentioned initially such that damage which results when a lamp is removed in the prior art can be avoided in a reliable manner.

The invention is based on the knowledge that the above-described problem can be counteracted if two voltage potentials are compared with one another, the difference between these two voltage potentials being dependent on whether a lamp has been removed from the circuit arrangement.

If the two voltage potentials are selected such that they are equal when all of the lamps are inserted, it is possible in a simple manner for further measures to be taken to protect the transistors in the drive circuit when a discrepancy between the two voltage potentials is established. According to the invention, a deactivation apparatus is accordingly also provided for the purpose of deactivating the drive circuit, the comparator circuit being designed to activate the deactivation apparatus if the difference between the first and the second voltage potential exceeds a predeterminable limit value. This measure automatically prevents operation of the drive circuit and thus a risk to the transistors used in the drive circuit if a lamp has been removed from the circuit arrangement.

The second voltage potential preferably depends on the voltage potential across each second filament of each lamp. If a half-bridge circuit is used in the drive circuit, the respective second filament of each lamp is connected to the center point of this half-bridge circuit via in each case one lamp inductor.

It is preferred if the difference between the first and the second voltage potential, if all of the lamps are inserted, is less than the predeterminable limit value and, if at least one lamp is not inserted, is greater than the predeterminable limit value.

The circuit arrangement preferably comprises a second voltage divider, at which the second voltage potential can be tapped off, the supply voltage of the second voltage divider being formed by the large number of voltages across the respective second filament of each lamp. As a result of the fact that each lamp thus contributes to the second voltage potential via its second filament, the removal of a lamp leads to mistuning which, given suitable dimensions, leads to the second voltage potential being changed such that the predeterminable limit value is exceeded.

Since the comparator circuit is designed for operating lamps using a radiofrequency signal, a time controller is preferably also provided which is designed to deactivate the deactivation apparatus over a predeterminable period of time, in particular during preheating and starting of the lamps. In one preferred embodiment, the time controller is therefore supplied with voltage via a DC path, which flows in series through the respective first filament of each lamp.

One particularly preferred embodiment is finally characterized by the fact that it also comprises a starting apparatus for the purpose of starting driving of the lamps by means of the drive circuit, the starting apparatus being supplied with voltage via a DC path, which flows in series through the respective first filament of each lamp, the circuit arrangement being designed such that at least one lamp inserted in the circuit arrangement is connected to a second voltage potential via the direct current flowing in each case through the second filament, said second voltage potential being different from the first voltage potential by less than the predeterminable limit value. This embodiment takes into account so-called "relamping", i.e. starting of the circuit arrangement once a lamp has been reinserted without it being necessary to interrupt the power supply system. The DC ratio at the comparator circuit is accordingly of significance for relamping. The starting apparatus is accordingly only enabled again when every lamp is inserted. Since, however, a holding element, for example a capacitor of large magnitude which is charged via the difference between the first and the second voltage potential and whose discharge may last for a crucial period of time, is often used for stabilizing the trigger condition for the activation of the deactivation apparatus, in which case the circuit arrangement is designed such that even the presence of a lamp in the circuit arrangement in the DC case results in a second voltage potential which is different from the first voltage potential by less than the predeterminable limit value. The discharge of the holding element is thus triggered as early as when a lamp is removed, with the result that it can reliably be assumed that, when the new second lamp is inserted, the holding element is discharged and no longer represents an obstacle to starting the circuit arrangement.

Further preferred embodiments are described in the dependent claims.

BRIEF DESCRIPTION OF THE DRAWINGS

An exemplary embodiment will now be described below with reference to the attached drawing, which shows a preferred exemplary embodiment of a circuit arrangement according to the invention.

DETAILED DESCRIPTION OF THE INVENTION

FIG. 1 shows a schematic illustration of a circuit arrangement having a first S1 and a second switch S2 in a half-bridge arrangement, the so-called intermediate-circuit voltage $U_{ZW}$ being applied to said switches. By way of example, two lamps LP1, LP2 are inserted in the circuit arrangement, in which case the principle of the present invention can of course also be transferred to circuit arrangements having a plurality of lamps. The lamp LP1 has a first filament W11 and a second filament W12. The lamp LP2 correspondingly has a first filament W21 and a second filament W22. The center point M of the half-bridge arrangement is connected on one side to the second filament W12 of the lamp LP1 via an inductor L1 and on the other side to the second filament W22 of the lamp LP2 via the inductor L2. The center point M of the half-bridge circuit is connected to the intermediate-circuit voltage $U_{ZW}$ via a resistor R1. Said intermediate-circuit voltage $U_{ZW}$ is also applied to the series circuit comprising the resistors R3 and R6 via a resistor R2. The filament W11 of the lamp LP1 is also connected to the resistor R2. The point P between the two first filaments W11 and W21 is connected to the intermediate-circuit voltage $U_{ZW}$ via the coupling capacitor C1. A resonant capacitor C2 is connected in parallel with the first lamp LP1, and a resonant capacitor C3 is connected in parallel with the second lamp LP2. The second filament W12 of the lamp LP1 is coupled to a resistor R7 via a resistor R4, and the second filament W22 of the lamp LP2 is coupled to a resistor R7 via a resistor R5. The voltage drop U6 across the resistor R6 and the voltage drop U7 across the resistor R7 are applied to a comparator circuit 10. The output of the comparator circuit 10 is connected to a capacitor $C_H$, across which there is a voltage drop $U_H$. The filament W21 of the lamp LP2 is connected on one side to a starting apparatus 12 and on the other side to a time controller 14 via a resistor R8. The voltage $U_H$ is applied to a deactivation apparatus 16, which drives a drive circuit 18 for the switches S1, S2. Moreover, the drive circuit 18 is driven by the starting apparatus 12.

Operation:

During radiofrequency operation, the two voltage potentials U6 and U7 applied to the comparator circuit 10 are essentially identical. In this case, the voltage U6 results from the intermediate-circuit voltage $U_{ZW}$ owing to a current flow through the coupling capacitor C1, the filament W11, and the resistor R3 via the voltage drop across the resistor R6. The voltage U7 results during radiofrequency operation from the intermediate-circuit voltage $U_{ZW}$ owing to a current flow through the coupling capacitor C1, the filament W11, the filament W12 and the resistor R4, on the one hand, and the filament W21, the filament W22 and the resistor R5, on the other hand, owing to the voltage drop U7 across the resistor R7.

If one of the two lamps LP1, LP2 is now removed from the circuit arrangement, mistuning results, i.e. the difference between the two voltage potentials U7 and U6 is altered and, depending on the dimensions, exceeds a predeterminable limit value. The difference between the two voltages U6, U7 is applied to the output 20 of the comparator circuit 10 as a voltage $U_H$ and charges the capacitor $C_H$. This voltage $U_H$ is supplied to the deactivation apparatus 16, which deactivates the drive circuit 18 via the line 22 as long as this voltage exceeds the predeterminable limit value. Since, during preheating and starting of the lamps, a voltage $U_H$ can also result which is above the predeterminable limit value, the time controller 14 is provided which deactivates the deactivation apparatus 16 during this period of time.

Following disconnection by means of the deactivation apparatus 16, the DC paths are critical, the voltage U6 in this case resulting owing to the voltage drop across the resistor R6 as a result of a current flow via R2, R3 and R6. The voltage U7 results owing to a current flow, on the one hand, via R1, L1, W12, R4 and, on the other hand, via a current flow via R1, L2, W22, R5 via the voltage drop U7 across the resistor R7. In this case, the resistors R2, R3, R6, on the one hand, and R1, R4, R5, R7, on the other hand, are dimensioned such that the voltage $U_H$, which corresponds to the difference between the voltages U6 and U7, is smaller than the predeterminable limit value once the lamp LP1 or LP2 has been removed from the circuit arrangement, with the result that the deactivation of the deactivation apparatus 16 is cancelled. However, initially, the drive circuit 18 is not started again yet. Only when the first removed lamp LP1 or LP2 is inserted in the circuit arrangement again is a starting apparatus 12 supplied with current again, because it is arranged in series with the DC path of the current flowing through the respective first filament W11, W21 of each lamp LP1, LP2. As soon as the starting apparatus 12 is supplied with current again, a start signal is applied to the drive circuit 18 via the line 24, whereupon the drive circuit 18 again drives the switches S1, S2 using a radiofrequency signal. Once the lamp has been reinserted, the circuit arrangement according to the invention thus starts without it having been necessary to interrupt the power supply system.

In order that the voltage $U_H$ is always positive, an absolute-value generator function can be provided in the comparator circuit 10, and this function provides the absolute value for the difference between the voltages U6 and U7 at the output 20 of the comparator circuit 10. Without deviating from the principle of the invention, other switching elements, for example a digital holding element, may also be provided instead of the capacitor $C_H$.

The invention claimed is:

1. A circuit arrangement for operating at least one first (LP1) and one second (LP2) lamp which can be inserted in said circuit arrangement, each lamp (LP1; LP2) having a first (W11; W21) and a second filament (W12; W22), having a drive circuit (18) for the purpose of driving the at least one first (LP1) and second (LP2) lamp, the drive circuit (18) being designed to operate the at least one first (LP1) and second (LP2) lamp using a radiofrequency signal, characterized in that it also comprises:

a comparator circuit (10) for the purpose of comparing a first (U6) and a second (U7) voltage potential within the circuit arrangement, and a deactivation apparatus (16) for the purpose of deactivating the drive circuit (18), the comparator circuit (10) being designed to activate the deactivation apparatus (16) if the difference between the first (U6) and the second (U7) voltage potential exceeds a predeterminable limit value during operation of the at least one first (LP1) and one second (LP2) lamp using a radiofrequency signal.

2. The circuit arrangement as claimed in claim 1, characterized in that the second voltage potential (U7) depends on the voltage potential across each second filament (W12; W22) of each lamp (LP1; LP2).

3. The circuit arrangement as claimed in claim 2, characterized in that the difference between the first (U6) and the second (U7) voltage potential, if all of the lamps are inserted, is less than the predeterminable limit value and, if at least one lamp is not inserted, is greater than the predeterminable limit value.

4. The circuit arrangement as claimed in claim 3, characterized in that the circuit arrangement comprises a first voltage divider, at which the first voltage potential (U6) can be tapped off.

5. The circuit arrangement as claimed in claim 4, characterized in that the circuit arrangement comprises a second voltage divider, at which the second voltage potential (U7) can be tapped off, the supply voltage of the second voltage divider being formed by the large number of voltages across the respective second filament (W12; W22) of each lamp (LP1; LP2).

6. The circuit arrangement as claimed in claim 4, characterized in that it also comprises a time controller (14) which is designed to deactivate the deactivation apparatus (16) over a predeterminable period of time, in particular during preheating and starting of the lamps.

7. The circuit arrangement as claimed in claim 3, characterized in that the circuit arrangement comprises a second voltage divider, at which the second voltage potential (U7) can be tapped off, the supply voltage of the second voltage divider being formed by the large number of voltages across the respective second filament (W12; W22) of each lamp (LP1; LP2).

8. The circuit arrangement as claimed in claim 3, characterized in that it also comprises a time controller (14) which is designed to deactivate the deactivation apparatus (16) over a predeterminable period of time, in particular during preheating and starting of the lamps.

9. The circuit arrangement as claimed in claim 2, characterized in that the circuit arrangement comprises a second voltage divider, at which the second voltage potential (U7) can be tapped off, the supply voltage of the second voltage divider being formed by the large number of voltages across the respective second filament (W12; W22) of each lamp (LP1; LP2).

10. The circuit arrangement as claimed in claim 2, characterized in that it also comprises a time controller (14) which is designed to deactivate the deactivation apparatus (16) over a predeterminable period of time, in particular during preheating and starting of the lamps.

11. The circuit arrangement as claimed in claim 10, characterized in that the time controller (14) is supplied with voltage via a DC path, which flows in series through the respective first filament (W11; W21) of each lamp (LP1; LP2).

12. The circuit arrangement as claimed in claim 1 characterized in that it also comprises a starting apparatus (12) for the purpose of starting driving of the lamps by means of the drive circuit (18), the starting apparatus (12) being supplied with voltage via a DC path, which flows in series through the respective first filament (W11; W21) of each lamp (LP1; LP2), the circuit arrangement being designed such that at least one lamp inserted in the circuit arrangement is connected to a second voltage potential (U7) via the direct current flowing in each case through the second filament, said second voltage potential (U7) being different from the first voltage potential (U6) by less than the predeterminable limit value.

* * * * *